US010694873B2

(12) United States Patent
McEntee

(10) Patent No.: US 10,694,873 B2
(45) Date of Patent: Jun. 30, 2020

(54) INFLATABLE TRAVEL SLEEP AID

(71) Applicant: Stuart Austin McEntee, Duxbury, MA (US)

(72) Inventor: Stuart Austin McEntee, Duxbury, MA (US)

( * ) Notice: Subject to any disclaimer, the term of this patent is extended or adjusted under 35 U.S.C. 154(b) by 175 days.

(21) Appl. No.: 15/838,105

(22) Filed: Dec. 11, 2017

(65) Prior Publication Data

US 2018/0289182 A1 Oct. 11, 2018

Related U.S. Application Data

(60) Provisional application No. 62/432,604, filed on Dec. 11, 2016.

(51) Int. Cl.

| | |
|---|---|
| ***A47G 9/10*** | (2006.01) |
| ***A47C 16/00*** | (2006.01) |
| ***A47C 7/38*** | (2006.01) |

(52) U.S. Cl.

CPC ..... *A47G 9/1027* (2013.01); *A47C 7/383* (2013.01); *A47C 16/00* (2013.01); *A47G 9/1081* (2013.01)

(58) Field of Classification Search

USPC ..... 297/397

See application file for complete search history.

(56) References Cited

U.S. PATENT DOCUMENTS

| | | | | |
|---|---|---|---|---|
| 4,235,472 | A * | 11/1980 | Sparks | A45C 9/00 108/43 |
| 5,528,784 | A * | 6/1996 | Painter | A47G 9/10 5/636 |
| 5,642,543 | A * | 7/1997 | Huntley | A47G 9/10 5/490 |
| 6,779,211 | B1 * | 8/2004 | Williams | A47D 13/08 5/640 |
| 9,526,360 | B2 * | 12/2016 | Sternlight | A47G 9/02 |
| 2007/0033737 | A1 * | 2/2007 | Melton | A47C 7/383 5/640 |
| 2009/0235459 | A1 * | 9/2009 | Tidwell | A47C 16/00 5/640 |
| 2016/0066697 | A1 * | 3/2016 | Adams | A47G 9/1081 5/636 |
| 2018/0332983 | A1 * | 11/2018 | Son | A47G 9/1027 |

* cited by examiner

*Primary Examiner* — Sarah B McPartlin

(57) ABSTRACT

The invention is a sleep aid, and more particularly an inflatable sleep aid utilizing a series of c-shaped inflatable bladders joined in series to such that the height of the sleep aid is adjustable and forming a generally c-shaped channel to allow the user to comfortably breath.

1 Claim, 4 Drawing Sheets

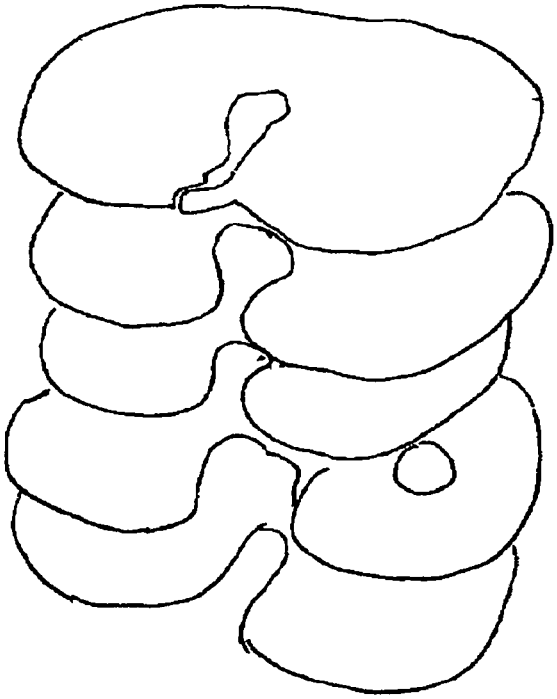
FIG #1

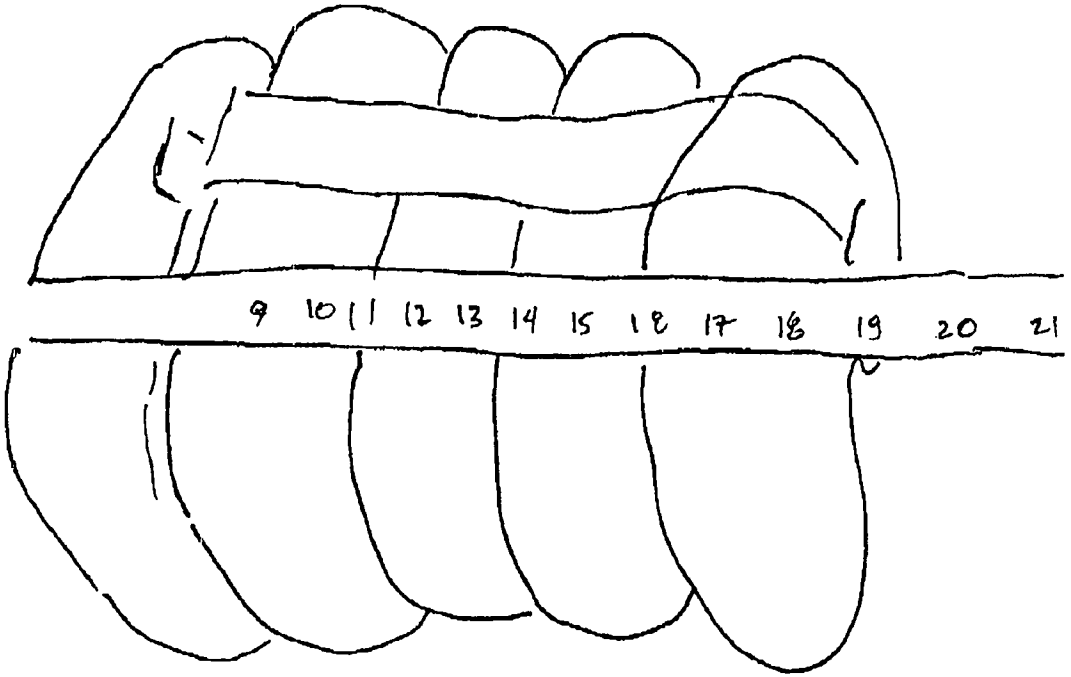
FIG #2

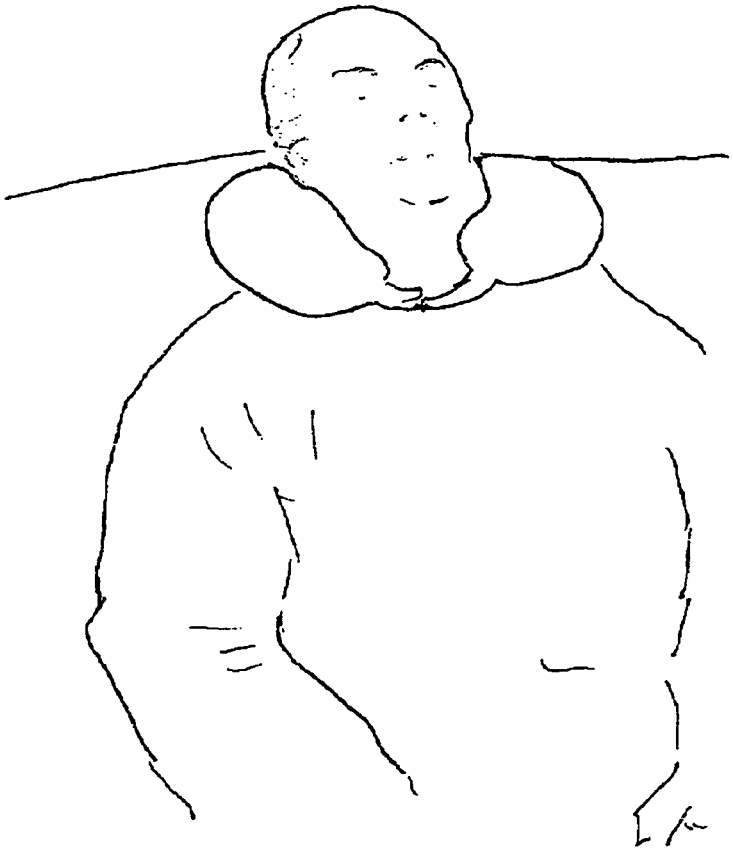
FIG #3

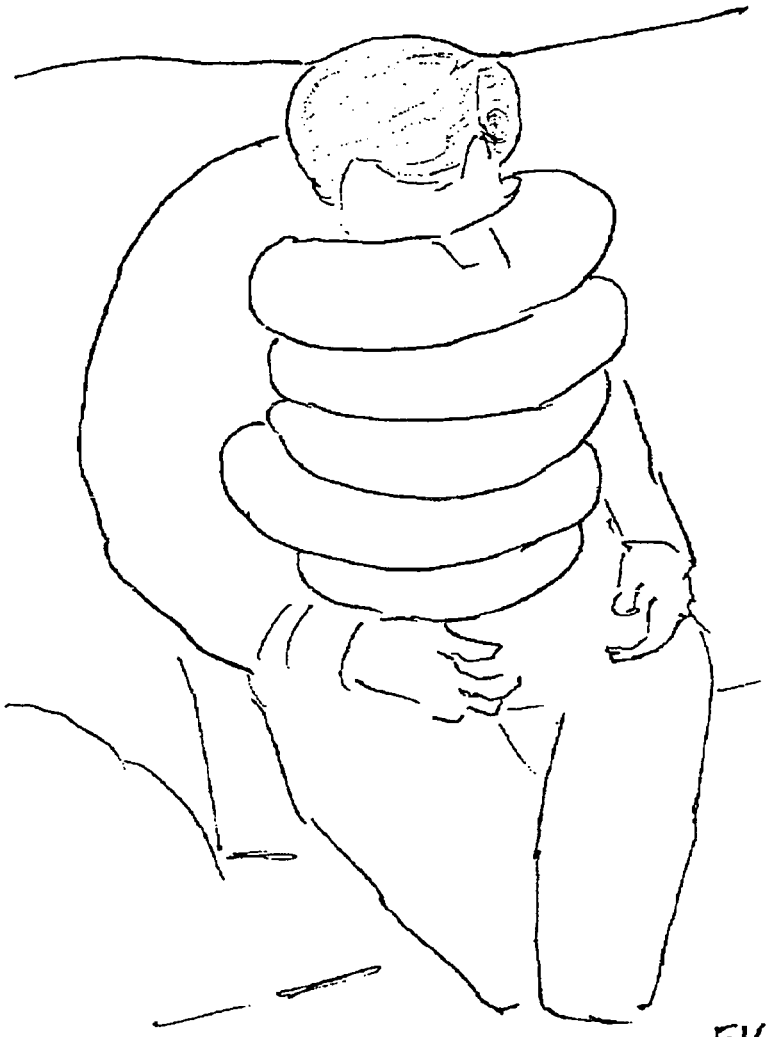
FIG #4

INFLATABLE TRAVEL SLEEP AID

INTRODUCTION

A travel pillow designed to allow a person to lean forward and have their head supported as the rest. The unique feature of this travel pillow is that it is designed to provide support from the front rather than the back. It essentially allows the user to lean forward effortlessly, place head down and rest/sleep. The pillow consists of multiple inflatable cones (2 to 20) that allow the height to adjust to each and every ones preferred resting height. Multiple inflatable sections/cylinders allowing the pillow to be placed and inflated to each and every persons preferred height. The cones are attached and can be inflated/deflated individually. This inflatable pillow to be placed on a surface in front for support (i.e. table/legs etc.) and will support the travelers head at their preferred height/comfort level.

One of the most unique features of this pillow is the top sections is detachable allowing this section to be utilized as a person leans back to support their head. This pillow is a multi-functional pillow allowing the user to have support as they rest sitting up or leaning forward.

Once used this pillow can be deflated and easily put in a travel pack for transport.

DESCRIPTION

Background of the Invention

The majority of the comfort devices are generally designed for a person to lean back. Generally you need to lean back 35 to 40 plus degrees for a comfortable resting position allowing one to rest/sleep. Most travelers are traveling sitting and this inflatable multi-cylinder adjustable pillow allows travelers to rest by leaning forward and or back supporting their head. When detaching the top cylinder/section the traveler can also lean back and use the tip section to support sleeping sitting up or leaning back.

SUMMARY OF THE INVENTION

The present invention is a travel pillow, it can easily deflated and packaged for travel. The pillow can be used in trains, planes, automobiles or just catching a quick rest at ones work seat. The pillow wen inflated is firm and offers support to allow one to lean forward of sit upright with comfort and rest being supported from the front. It is unique in that is supports the traveler leaning forward or backwards allowing the traveler to sleep/rest comfortably. The invention consists of multi-cylinder/sections pillow ranging from 1.5 to 2 cubic feet that when inflated is firm or support when leaning forward, or detaching the top section to support head from a sitting position.

The travel pillow when inflated is a large firm support mechanism, yet comfortable to engage and encourage rest/sleep.

BRIEF DESCRIPTION OF THE DRAWINGS

FIG. 1: shows a front perspective view of the invention, including dimensions (Showing 5 cylinders/sections)

FIG. 2: shows a rear perspective view of the invention, Including dimensions.

FIG. 3: depicts the pillow in use. What is shown is a side view of the person sitting in a chair using the pillow leaning forward using the pillow for support. The rear-most seat is occupied by a passenger who is using the pillow.

FIG. 4: depicts the pillow in use. What is shown is a side view of the person sitting in a chair using the top cylinder/cone pillow around the neck for support.

DETAILED DESCRIPTION OF THE INVENTION

The claims of this application include any embodiment of the travel pillow as described herein. To minimize the length of the application a single, preferred embodiment is described and illustrated.

The preferred embodiment is an inflatable pillow. This allows easy portability and compact size when not inflated. One key feature is the size of the valve used to inflate and deflate the pillow. The diameter is at least ½ inch allowing easy inflation by the mouth with minimally restricted airflow. When it comes time to deflate the pillow it can be done rapidly for the same reason.

As shown in FIGS. 1 and 2 the pillow is roughly a rectangular cube but with the tip slanted to provide a more comfortable angle to incline and rest the head. As mentioned above the inflation valve is of standard type having a diameter or ½ inch for fast inflation deflation. The inflation valves are located on the side for easy access and so that it cannot cause discomfort. The top cylinder/cone has memory form and fabric to provide comfort.

The construction is quite simple allowing for very cost effective manufacturing. The material used can be either sheet vinyl or PVC of about 0.003" thickness. Each cylinder/cone can be made from only three pieces of material, top bottom and the composite sides. These cylinders/cones will be assembled/fastened glued (2 to 20) one on top of each other until the desired height is attained. The top cylinder/cone is a combination of cylinder/memory foam and covered in cloth for comfort.

Although the above description describes a specific implementation of the invention, this should not be construed as limitations on the scope of the invention. Many variations are possible, which would be obvious to anyone skilled in the art of industrial design. Accordingly, the scope of the inventions should be determined by the scope of the appended claims and not just by the embodiments described and illustrated herein.

What is claimed is:

1. An inflatable pillow having a volume of approximately 1.5 to 2 cubic feet comprising:

a plurality of inflatable u-shaped supports stacked on top of each other;

a top inflatable u-shaped support comprising memory foam and an inflatable bladder, wherein the top inflatable u-shaped support is detachably connected by a fastener to the plurality to inflatable u-shaped supports;

wherein when the top inflatable u-shaped support is detached from the plurality of said inflatable u-shaped supports it is configured be positioned around a person's neck and to support said person's head from behind when said person is seated in a seat; and wherein when the top inflatable support is attached to the plurality of inflatable u-shaped supports the inflatable pillow is configured to support said person's head in a forward leaning seated position wherein a degree of inflation of said inflatable pillow can be varied via at least one inflation valve to accommodate users of various heights and provide various levels of cushioning.

* * * * *